US011118772B2

(12) United States Patent
Hou et al.

(10) Patent No.: US 11,118,772 B2
(45) Date of Patent: Sep. 14, 2021

(54) TOILET LAMP WITH PROXIMITY SENSING AND FLEXIBLE ATTACHMENT

(71) Applicant: XIAMEN LEEDARSON LIGHTING CO.,LTD, Fujian (CN)

(72) Inventors: Shouqiang Hou, Fujian (CN); Xiaoliang Wen, Fujian (CN); Zhenkun Huang, Fujian (CN)

(73) Assignee: XIAMEN LEEDARSON LIGHTING CO., LTD, Xiamen (CN)

( * ) Notice: Subject to any disclaimer, the term of this patent is extended or adjusted under 35 U.S.C. 154(b) by 0 days.

(21) Appl. No.: 16/989,538

(22) Filed: Aug. 10, 2020

(65) Prior Publication Data

US 2021/0215331 A1 Jul. 15, 2021

(30) Foreign Application Priority Data

Dec. 23, 2019 (CN) ..... 201922335078.X

(51) Int. Cl.

| | |
|---|---|
| ***F21V 23/04*** | (2006.01) |
| ***A47K 17/00*** | (2006.01) |
| ***F21V 23/00*** | (2015.01) |
| ***F21V 17/12*** | (2006.01) |
| ***F21S 9/02*** | (2006.01) |
| *F21Y 115/10* | (2016.01) |

(52) U.S. Cl.

CPC ..... *F21V 23/0471* (2013.01); *A47K 17/00* (2013.01); *F21S 9/02* (2013.01); *F21V 17/12* (2013.01); *F21V 23/004* (2013.01); *F21Y 2115/10* (2016.08)

(58) Field of Classification Search

CPC .... F21V 23/0471; F21V 23/004; F21V 17/12; F21S 9/02; F21Y 2115/10; A47K 17/00

See application file for complete search history.

(56) References Cited

U.S. PATENT DOCUMENTS

| | | | | |
|---|---|---|---|---|
| 5,136,476 A * | 8/1992 | Horn | A47K 17/00 | 362/198 |
| 5,150,962 A * | 9/1992 | Rauschenberger | A47K 17/00 | 362/101 |
| 5,513,397 A * | 5/1996 | Terry | F21V 21/08 | 4/661 |
| 8,398,257 B1 * | 3/2013 | Paulus | F21V 23/0492 | 362/183 |

(Continued)

*Primary Examiner* — Zheng Song

(74) *Attorney, Agent, or Firm* — Chun-Ming Shih; Lanway IPR Services

(57) ABSTRACT

A toilet lamp includes a battery box, a metal flexible bar, an insulative sleeve and a light source. The battery box includes at least one battery, a driving component, a sensing module, a cap and a lens. The sensing module detects human presence in the toilet lamp's proximity. The cap covers the driving component. The lens is mounted on the cap. The lens is optically coupled to the sensing module. The lens amplifies an optical disturbance occurred in the toilet lamp's proximity. The lens relays the amplified optical disturbance to the sensing module as a reference in detecting the human presence. The sensing module activates the light source upon detecting the human presence within the toilet lamp's proximity. The sensing module deactivates the light source upon detecting the human presence's leaving from the toilet lamp's proximity.

20 Claims, 3 Drawing Sheets

(56) References Cited

U.S. PATENT DOCUMENTS

| | | | | |
|---|---|---|---|---|
| 2008/0028505 | A1* | 2/2008 | Penn | E03D 9/007 4/231 |
| 2013/0038225 | A1* | 2/2013 | Brian R. | H05B 31/50 315/159 |
| 2016/0138254 | A1* | 5/2016 | Chimene | E03D 9/00 4/661 |
| 2017/0122535 | A1* | 5/2017 | Alexander | A61L 9/14 |
| 2018/0003374 | A1* | 1/2018 | Bulcao | F21V 23/0471 |
| 2018/0223517 | A1* | 8/2018 | Wood | E03D 9/005 |
| 2018/0334788 | A1* | 11/2018 | Wood | E03D 9/005 |
| 2019/0060503 | A1* | 2/2019 | Alexander | G02B 6/00 |

* cited by examiner

TOILET LAMP WITH PROXIMITY SENSING AND FLEXIBLE ATTACHMENT

FIELD

The present invention relates to a toilet lamp, and more particularly, to a toilet lamp capable of illuminating based on human presence in its proximity.

BACKGROUND

A toilet is a necessary household item. Also, a toilet's material, shape and function is getting higher and higher requirements. For example, when a human would like to use a toilet at night during his/her sleep period, he/she needs to find a lamp switch for required luminance in advance. However, such luminance at night may hurt the human's sleep significantly because the human's pupils may abruptly and forcedly expand caused by a sudden change from a dark environment to an enlightened environment.

SUMMARY

The present disclosure aims at disclosing a toilet lamp that includes a battery box, a metal flexible bar, an insulative sleeve and a light source. The battery box includes at least one battery, a driving component, a sensing module, a cap and a lens. The driving component is electrically coupled to the at least one battery for charging. The sensing module is electrically coupled to the driving component for being driven by the driving component. Also, the sensing module detects human presence in the toilet lamp's proximity. The cap covers the driving component. The lens is mounted on the cap. Besides, the lens is optically coupled to the sensing module. Moreover, the lens amplifies an optical disturbance occurred in the toilet lamp's proximity. Additionally, the lens relays the amplified optical disturbance to the sensing module as a reference in detecting the human presence. The metal flexible bar has a first terminal that penetrates the cap for electrically coupling to the sensing module. Also, the metal flexible bar's second terminal lies external to the cap. The insulative sleeve encloses the second terminal of the metal flexible bar. The light source is electrically coupled to the second terminal of the metal flexible bar. The metal flexible bar and the insulative flexible sleeve form a flexible hook that articulates with the toilet for installing the toilet light on the toilet. The sensing module activates the light source upon detecting the human presence within the toilet lamp's proximity. Besides, the sensing module deactivates the light source upon detecting the human presence's leaving from the toilet lamp's proximity.

In one example, the sensing module includes a passive infrared (PIR) motion sensor switch.

In one example, the metal flexible bar includes at least one of a weaved thin copper plate and a copper wire.

In one example, the sensing module also deactivates the light source after a period of delay upon detecting the human presence's leaving from the toilet lamp's proximity.

In one example, the battery box also includes an upper housing and a lower housing. And the lower housing is detachably coupled to the upper housing.

In one example, the upper housing includes an installation component that receives the at least one battery.

In one example, the upper housing includes an installation plate that installs the driving component.

In one example, the upper housing includes at least one screw receiver that fixes the installation plate by screwing.

In one example, the at least one screw receiver includes at least one of an insulative sleeve that has screw threads inside.

In one example, the at least one screw receiver includes at least one of rubber and plastic material.

In one example, the upper housing and the lower housing are detachably coupled to each other via at least one of tongue-and-groove fit, snap fit, interference fit, post-and-bore fit, and press fit.

In one example, the lower housing includes at least one rib that is circumferentially and inwardly expanding. The upper housing includes at least one circumferential groove that is respective corresponding to and detachably engaged to the at least one rib via tongue-and-groove fit.

In one example, each of the at least one circumferential groove includes a circumferential abutment. The circumferential abutment supports the rib while the rib slides into the circumferential groove for engaging. Moreover, the circumferential abutment stops the rib from detachably falling from the circumferential groove after the rib slides into the circumferential groove.

In one example, a height of the circumferential abutment is no larger than a height of the circumferential groove. And an arc length difference between the circumferential groove and the circumferential abutment is no shorter than an arc length of the rib.

In one example, the rib further includes a recess, and the circumferential groove further includes a post. The recess receives the post to form a press fit when the rib is slid into the circumferential groove.

In one example, the cap includes a bore that encompasses the lens.

In one example, the cap includes a connection sleeve. And the metal flexible bar penetrates through the connection sleeve for being electrically coupled to the sensing module.

In one example, the connection sleeve includes a first flexible opening, and the insulative sleeve includes a second flexible opening. The first flexible opening and the second flexible opening form an interference fit that renders the connection sleeve to be detachably engaged with the insulative sleeve.

In one example, at least one of the first flexible opening and the second flexible opening is coated with an insulation layer.

In one example, the connection sleeve is integrated with the cap.

In one example, the light source includes a light emitting diode (LED) unit and a lampshade. The LED unit is electrically coupled to the metal flexible bar. The lampshade is disposed on the insulative sleeve. Also, the lampshade covers the LED unit.

In one example, the lampshade is coupled to the insulative sleeve via interference fit.

In one example, a connection between the lampshade and the insulative sleeve is coated with an insulation layer.

DETAILED DESCRIPTION

As mentioned above, the present disclosure discloses a toilet lamp that can illuminance upon a human's presence in its proximity. In addition, the disclosed toilet light illuminates in an indirect manner that the human's pupils will not receive direct lights from the toilet lamp. Such that the human's sleeping quality will not be significantly damaged.

In some examples, the toilet lamp is installed on a toilet's lid and coupled to the toilet's base. Such that when a human lift or puts the lid, he/she lifts or puts the toilet lamp as well.

Figure 1:
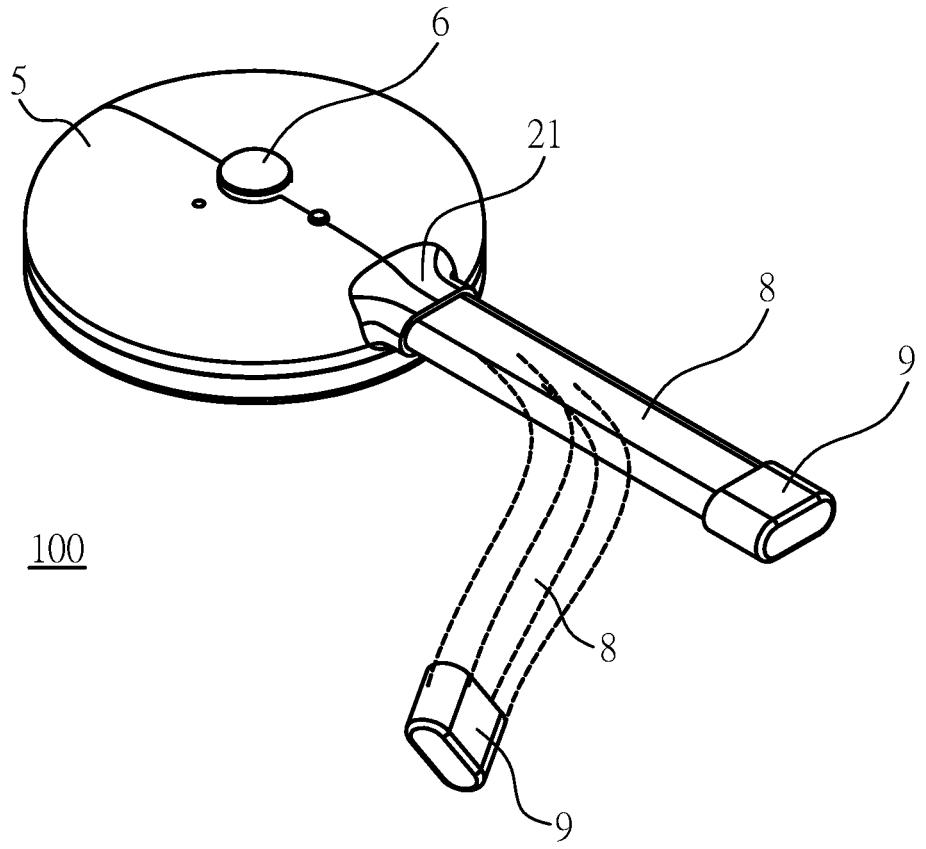
FIG. 1 illustrates a stereogram of a toilet lamp according to one example of the present disclosure.
Figure 2:
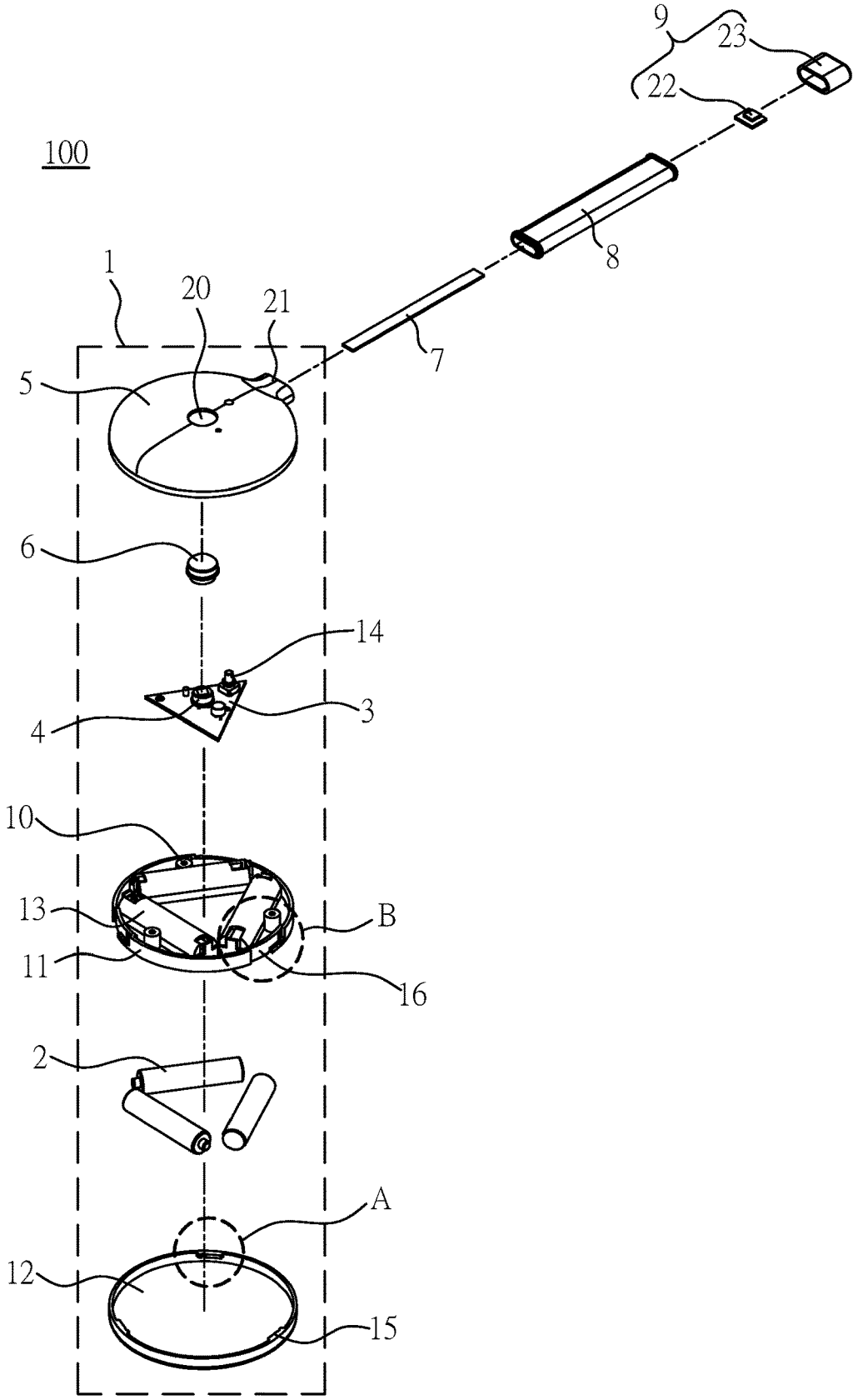
FIG. 2 illustrates an exploded diagram of the toilet lamp shown in FIG. 1 according to one example.

FIG. 1 illustrates a stereogram of a toilet lamp 100 according to one example of the present disclosure. In addition, FIG. 2 illustrates an exploded diagram of the toilet lamp 100 shown in FIG. 1 according to one example.

The toilet lamp 100 includes at least a battery box 1, at least one battery 2, a driving component 3, a sensing module 4, a cap 5, a lens 6, a metal flexible bar 7, an insulative sleeve 8, and a light source 9.

The battery box 1 encompasses the at least one battery 2. The driving component 3 is disposed at an inner top side of the battery box 1 and is electrically coupled to the at least one battery 2 for charging. The sensing module 4 is installed above and electrically coupled to the driving component 3 for being driven by the driving component 3. The cap 5 is installed at a top side of the battery box 1 for covering the driving component 3. The lens 6 is mounted on the cap 5. Also, the sensing module 4 detects human presence in the toilet lamp 100's proximity with the aid of the lens 6. The metal flexible bar 7 has a first terminal that penetrates the cap 5 for electrically coupling to the sensing module 4. In addition, the metal flexible bar 7's second terminal lies external to the cap 5. Besides, the metal flexible bar 7 is enclosed by an insulative flexible sleeve 8 at its second terminal. The light source 9 is electrically coupled to the metal flexible bar 7's second terminal. It is noted that the metal flexible bar 7 and the insulative flexible sleeve 8 forms a flexible hook that articulates with a toilet's edge for installing the toilet lamp 100 on said toilet.

In some examples, the sensing module 4 is implemented using a passive infrared (PIR) motion sensor switch. Specifically, when a human enters the toilet lamp 100's proximity (i.e., the sensing module 4's effective detection range), the sensing module 4 senses an instant infrared change caused by the human. Then the sensing module 4 keeps on being conducting its loading during a period that the human lasts within the toilet lamp 100's proximity. Therefore, after the human leaves the toilet lamp 100's proximity, the sensing module 4 insulates its loading with a short period of delay. In some examples, the metal flexible bar 7 is implemented using weaved thin copper plate or copper wire. Besides, the metal flexible bar 7 conducts the light source 9 with the sensing module 4 and the driving component 3.

The toilet lamp 100's advantage lies in the following facts. Specifically, the combination of the metal flexible bar 7 and the insulative flexible sleeve 8 can be arbitrarily bended to form a flexible hook that in turn hooks the toilet's edge, which may be connected to the toilet's base. The light source 9 can be disposed within an internal space of the toilet, and both the battery box 1 and the cap 5 are disposed external to the toilet. In this way, when a human approaches the toilet lamp 100's proximity (e.g., while flipping up the toilet's lid), the sensing module 4 detects the human's presence via the lens 6 and activates the light source 9 via the driving component 3. Such that the light source 9 illuminates the toilet's internal space. On the contrary, when the human leaves the toilet lamp 100's proximity, the sensing module 4 perceives the human's leaving. Therefore, the sensing module 4 then switches off (i.e., deactivate) the light source 9 with a short period of delay, for example, about five to ten seconds after losing the human's presence. In this way, during the night when the toilet's surrounding is in dark, as long as a human approaches the toilet's proximity, the toilet lamp 100's light source 9 is automatically activated without directly illuminating towards his/her eyes. Such that the human's sleeping quality is better kept. Also, when the human leaves the toilet lamp 100's proximity, the toilet lamp 100 automatically switches off the light source 9 with a short period of delay. Therefore, the toilet lamp 100's power consumption can be reduced and effectively controlled.

As shown in FIG. 2, the battery box 1 includes an upper housing 11 and a lower housing 12 that is detachably coupled to the upper housing 11. The upper housing 11 has an installation component 13 at its lower half for receiving the at least one battery 2. Also, the upper housing 11 has an installation plate 14 at its upper half for installing the driving component 3. The detachable mechanism between the upper housing 11 and the lower housing 12 aids in conveniently replacing the at least one (e.g. low-power) battery 2 with other at least one new battery 2. In some examples, the installation plate 14 is triangular-shaped. The driving component 3 is electrically coupled to the at least one battery 2 (e.g., via conductive wires) for receiving power from the at least one battery 2.

In some examples, the upper housing 11 and the lower housing 12 are detachably coupled to each other via at least one of tongue-and-groove fit, snap fit, interference fit, post-and-bore fit, and press fit.

Figure 3:
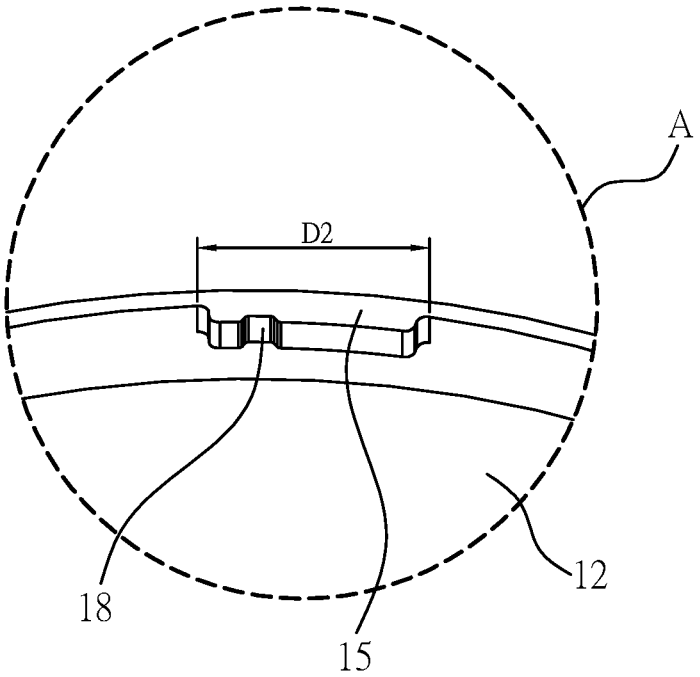
FIG. 3 illustrates a specific region that encloses part of the lower housing shown in FIG. 2.
Figure 4:
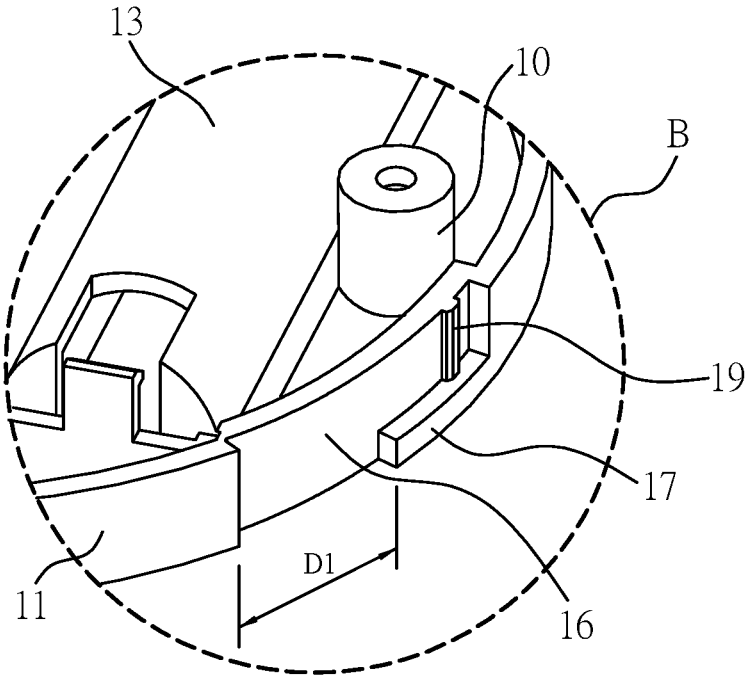
FIG. 4 illustrates a specific region that encloses part of the upper housing shown in FIG. 2.

FIG. 3 illustrates a specific region A that encloses part of the lower housing 12 shown in FIG. 2. And FIG. 4 illustrates a specific region B that encloses part of the upper housing 11 shown in FIG. 2. As shown in FIGS. 2-4, the lower housing 12 includes at least one circumferentially- and inwardly-expanding rib 15. Also, the upper housing 11 includes at least one circumferential groove 16 that is respective corresponding to and detachably engaged to the at least one rib 15 via tongue-and-groove fit. Specifically, the circumferential groove 16's lower side has a circumferential abutment 17 for supporting the rib 15 while the rib 15 slides into the circumferential groove 16 for engaging. In addition, the circumferential abutment 17 stops the rib 15 from detachably falling from the circumferential groove 16 after the rib 15 slides into the circumferential groove 16. In some examples, the lower housing 12 includes three ribs 15, and the upper housing 11 includes three circumferential grooves 16. It is noted that the circumferential abutment 17's height is no larger than the circumferential groove 16's. Such that the circumferential groove 16 has a sufficient height for receiving the slid-in rib 15. Also, an arc length difference between the circumferential groove 16 and the circumferential abutment 17, i.e., an arc distance D1 as shown in FIG. 4, is no shorter than an arc length of the rib 15, i.e., an arc length D2 as shown in FIG. 3. Such that the circumferential groove 16 can encompass the rib 15 before further sliding the rib 15 into the circumferential groove 16 when the upper housing 11 is pushed downwards to engage the lower housing 12 or when the lower housing 12 is pushed upwards to engage the upper housing 11. Specifically, while engaging the upper housing 11 with the lower housing 12, and after the rib 15 enters the space indicated by the distance D1 within the circumferential groove 16, the upper housing 11 or the lower housing 12 is additionally rotated in a manner that further slides the rib 15 into an additional space that is partially enclosed by the circumferential groove 16 and the circumferential abutment 17. Additionally, after the rib 15 is slid into the additional space, the rib 15 is substantially supported by the circumferential abutment 17 from its bottom. Such that the rib 15 will not fall off the circumferential groove 16, and the detachable engagement between the upper housing 11 and the lower housing 12 becomes stronger. Upon detaching the upper housing 11 from the lower housing 12, one of the upper housing 11 and the lower housing 12 is reversely rotated in a manner that slides the rib 15 out of the additional space partially enclosed by the circumferential groove 16 and the circumferential abutment 17. Then the rib 15 can be moved out of the space indicated by the distance D1 from the circumferential groove 16 for completing the detachment of the upper housing 11 from the lower housing 12.

As shown in FIGS. 2-4, in some examples, the rib 15 additionally includes a recess 18, and the circumferential groove 16 further includes a post 19. During the sliding process that the rib 15 is slid into the circumferential groove 16, the recess 18 receives the post 19 to form a press fit that strengthens and stabilizes the detachable engagement between the upper housing 11 and the lower housing 12. In some examples, the recess 18 and the post 19 are designed in a manner that their press fit is orthogonal to the detachable engagement between the rib 15 and the circumferential groove 16. Similarly, upon detaching the upper housing 11 from the lower housing 12 and sliding the rib 15 out of the circumferential groove 16, the post 19 is also released out of the recess 18 for disengaging the press fit in between.

As shown in FIG. 2, in some examples, the upper housing 11 includes at least one screw receiver 10, and the installation plate 14 is fixed above the at least one screw receiver 10 via screwing corresponding screws (not illustrated) through the installation plate 14. In some examples, the screw receiver 10 is implemented using an insulative sleeve that has screw threads inside. Also, the screw receiver 10 may be made of rubber or plastic material. In some examples, the upper housing 11 includes three uniformly-distributed screw receivers 10. After being screwed on the at least one screw receiver 10, the installation plate 14's stability on the upper housing 11 is firmly ensured. Besides, by screwing off the screws from the at least one screw receiver 10, the installation plate 14 can be easily detached from the upper housing 11.

As shown in FIG. 2, the cap 5 includes a bore 20. Also, the bore 20 encompasses a lens 6 that is optically coupled to the sensing module 4. Therefore, when a human approach the toilet lamp 100's proximity, he or she may incur certain optical disturbance that passes through the lens 6 and then be amplified by the lens 6. In turn, the sensing module 4 detects the amplified optical disturbance from the lens 6. With the aid of the lens 6's amplification on the optical disturbance as a reference, the sensing module 4's sensitivity about the human's presence is significantly increased.

As shown in FIG. 2, the cap 5 additionally includes a connection sleeve 21. And the metal flexible bar 7 penetrates through the connection sleeve 21 for electrically coupled to the sensing module 4. In some examples, the connection sleeve 21 is disposed orthogonally to an axis of the cap 5. Also, the connection sleeve 21 outwardly extends from the cap 5. In some examples, the connection sleeve 21 has a first flexible opening, and the insulative sleeve 8 has a second flexible opening. Such that the connection sleeve 21 can be detachably engaged with the insulative sleeve 8 via an interference fit formed by the first flexible opening and the second flexible opening. It is noted that the metal flexible bar 7 can reach the sensing module 4 via both the first flexible opening and the second flexible opening. In some examples, at least one of the first flexible opening and the second flexible opening is further coated with an insulation layer for sealing and insulating the metal flexible bar 7 from exposing external to the insulative sleeve 8 and the connection sleeve 21. Moreover, the insulative sleeve 8 coats at least most of the metal flexible bar 7 for the metal flexible bar 7's protection and insulation.

As shown in FIG. 1 and FIG. 2, in some examples, the connection sleeve 21 is integrated with the cap 5. Such that the connection sleeve 21 has stronger structural connection, better protection, and more secure insulation with the cap 5.

As shown in FIG. 2, in some examples, the light source 9 includes a light emitting diode (LED) unit 22 and a lampshade 23. Specifically, the LED unit 22 is electrically coupled to the metal flexible bar 7. And the lampshade 23 is disposed on the insulative sleeve 8. Also, the LED unit 22 is covered by the lampshade 23 for preventing direct illumination. That is, the light source 9 can emit indirect luminance for preventing a human's pupils from rapidly expansion. In some examples, the lampshade 23 is coupled to the insulative sleeve 8 via interference fit, at which a connection in between may be coated with an insulation layer. Besides, the lampshade 23 can prevent the LED unit 22 from being sputtered by water from the toilet and in turn damaged by short-circuit.

The invention claimed is:

1. A toilet lamp, comprising:

a battery box, comprising:

at least one battery;

a driving component, electrically coupled to the at least one battery for charging;

a sensing module, electrically coupled to the driving component for being driven by the driving component, and configured to detect human presence in the toilet lamp's proximity;

a cap, configured to cover the driving component; and a lens, mounted on the cap, optically coupled to the sensing module, configured to amplify an optical disturbance occurred in the toilet lamp's proximity, and configured to relay the amplified optical disturbance to the sensing module as a reference in detecting the human presence;

a metal flexible bar, having a first terminal that is configured to penetrate the cap for electrically coupling to the sensing module, and having a second terminal that lies external to the cap;

an insulative sleeve, configured to enclose the second terminal of the metal flexible bar; and a light source, electrically coupled to the second terminal of the metal flexible bar;

wherein the metal flexible bar and the insulative flexible sleeve are further configured to form a flexible hook for installing the toilet light on the toilet; and wherein the sensing module is further configured to activate the light source upon detecting the human presence within the toilet lamp's proximity and is further configured to deactivate the light source upon detecting the human presence's leaving from the toilet lamp's proximity.

2. The toilet lamp of claim 1, wherein the battery box further comprises:

an upper housing; and a lower housing, detachably coupled to the upper housing.

3. The toilet lamp of claim 2, wherein the upper housing comprises:

an installation plate, configured to install the driving component.

4. The toilet lamp of claim 3, wherein the upper housing further comprises at least one screw receiver, configured to fix the installation plate by screwing.

5. The toilet lamp of claim 4, wherein the at least one screw receiver comprises at least one of an insulative sleeve that has screw threads inside.

6. The toilet lamp of claim 4, wherein the at least one screw receiver comprises at least one of rubber and plastic material.

7. The toilet lamp of claim 2, wherein the lower housing comprises at least one rib that is circumferentially and inwardly expanding; and wherein the upper housing comprises at least one circumferential groove respective corresponding to and detachably engaged to the at least one rib via tongue-and-groove fit.

8. The toilet lamp of claim 7, wherein each of the at least one circumferential groove comprises a circumferential abutment, configured to support the rib while the rib slides into the circumferential groove for engaging, and configured to stop the rib from detachably falling from the circumferential groove after the rib slides into the circumferential groove.

9. The toilet lamp of claim 7, wherein a height of the circumferential abutment is no larger than a height of the circumferential groove; and wherein an arc length difference between the circumferential groove and the circumferential abutment is no shorter than an arc length of the rib.

10. The toilet lamp of claim 7, wherein the rib further comprises a recess, and the circumferential groove further comprises a post;

wherein the recess is configured to receive the post to form a press fit when the rib is slid into the circumferential groove.

11. The toilet lamp of claim 2, wherein the upper housing comprises:

an installation component, configured to receive the at least one battery.

12. The toilet lamp of claim 2, wherein the upper housing and the lower housing are detachably coupled to each other via at least one of tongue-and-groove fit, snap fit, interference fit, post-and-bore fit, and press fit.

13. The toilet lamp of claim 1, wherein the cap comprises:

a connection sleeve, through which the metal flexible bar is further configured to penetrate for being electrically coupled to the sensing module.

14. The toilet lamp of claim 13, wherein the connection sleeve comprises a first flexible opening, and the insulative sleeve further comprises a second flexible opening;

wherein the first flexible opening and the second flexible opening are configured to form an interference fit that renders the connection sleeve to be detachably engaged with the insulative sleeve.

15. The toilet lamp of claim 14, wherein at least one of the first flexible opening and the second flexible opening is coated with an insulation layer.

16. The toilet lamp of claim 13, wherein the connection sleeve is integrated with the cap.

17. The toilet lamp of claim 1, wherein the sensing module comprises a passive infrared (PIR) motion sensor switch.

18. The toilet lamp of claim 1, wherein the metal flexible bar comprises at least one of a weaved thin copper plate and a copper wire.

19. The toilet lamp of claim 1, wherein the sensing module is further configured to deactivate the light source after a period of delay upon detecting the human presence's leaving from the toilet lamp's proximity.

20. The toilet lamp of claim 1, wherein the cap comprises:

a bore, configured to encompass the lens.

* * * * *